US007011082B2

(12) United States Patent
Hüsges

(10) Patent No.: US 7,011,082 B2
(45) Date of Patent: Mar. 14, 2006

(54) EXHAUST GAS FEEDING DEVICE FOR AN INTERNAL COMBUSTION MACHINE

(75) Inventor: Hans-Jürgen Hüsges, Willich (DE)

(73) Assignee: Pierburg GmbH, Neuss (DE)

( * ) Notice: Subject to any disclaimer, the term of this patent is extended or adjusted under 35 U.S.C. 154(b) by 0 days.

(21) Appl. No.: 10/918,450

(22) Filed: Aug. 16, 2004

(65) Prior Publication Data

US 2005/0034713 A1 Feb. 17, 2005

(30) Foreign Application Priority Data

Aug. 16, 2003 (DE) ..... 103 37 723

(51) Int. Cl.
*F02M 25/07* (2006.01)

(52) U.S. Cl. ..... 123/568.17; 123/568.18

(58) Field of Classification Search ..... 123/568.11, 123/568.17, 568.18, 184.21
See application file for complete search history.

(56) References Cited

U.S. PATENT DOCUMENTS 1,382,285 A * 6/1921 Harris ..... 123/568.17
4,119,071 A * 10/1978 Hattori ..... 123/568.17
4,327,698 A * 5/1982 Hamai et al. ..... 123/568.17
4,634,371 A * 1/1987 Bader ..... 123/568.17
5,957,116 A 9/1999 Haegele et al.
6,425,382 B1 * 7/2002 Marthaler et al. ..... 123/568.17

FOREIGN PATENT DOCUMENTS

| | | |
|---|---|---|
| DE | 196 45 280 A1 | 5/1997 |
| DE | 19645280 A1 | 5/1997 |
| DE | 10111391 A1 | 9/2002 |
| EP | 1 152 141 A1 | 11/2001 |
| WO | WO 00/51751 | 9/2000 |

OTHER PUBLICATIONS

European Search Report completed Nov. 30, 2004.
German Search Report, dated Mar. 30, 2004.

* cited by examiner

*Primary Examiner*—Willis R. Wolfe, Jr.
(74) *Attorney, Agent, or Firm*—Griffin & Szipl, P.C.

(57) ABSTRACT

Exhaust gas feeding device for a internal combustion machine for introducing exhaust gas into a suction channel section of an intake manifold through at least one opening, having an exhaust gas feed section, an exhaust gas feedback valve and an exhaust gas introduction plate that forms a annular channel in the wall region of the suction channel section, wherein the exhaust gas introduction plate is designed as a stamped part with formable webs in such a manner that the webs define a ring channel annular channel with openings in the built-in state of the exhaust gas introduction plate.

11 Claims, 5 Drawing Sheets

EXHAUST GAS FEEDING DEVICE FOR AN INTERNAL COMBUSTION MACHINE

This application claims priority from German Patent Application No. 10337723.9, filed 16 Aug. 2003, the entire disclosure of which is incorporated herein by reference.

1. Field of the Invention

The present invention relates to an exhaust gas feeding device for an internal combustion machine for feeding exhaust gas by means of at least one opening in a suction channel section of an aspirating tube, with one exhaust gas introducing section, one exhaust gas feedback valve and an exhaust gas introduction plate that forms a ring channel in the band region of the suction channel section.

2. Background of the Invention

An exhaust gas feeding device for an internal combustion machine is taught by DE A1 19645280. In this device, a seal is correspondingly formed around, and forms a ring channel between, the suction channel section, whereby the seal is formed so that the ring channel is connected to the suction channel over an annular opening. An exhaust gas feeding device of this kind has a disadvantage in that the seal must be precisely formed around the suction channel. Consequently, during the assembly process it is difficult to achieve a homogeneous annular opening for the introduction of exhaust gas in the assembled state.

It is therefore an object of the present invention to provide an exhaust gas feeding device for an internal combustion machine that is economical to produce and assemblyable in a simplified manner.

It is also an object of the present invention to provide an exhaust gas feeding device for an internal combustion machine that overcomes the disadvantages and limitations of the prior art exhaust gas feeding devices.

These objects are solved in accordance with the present invention by providing an exhaust gas feeding device for an internal combustion engine wherein the exhaust gas introduction plate is formed as a stamped part with surrounding unformed webs formed therein in such a manner that the webs, when formed, define openings in the ring channel in the built-in state of the exhaust gas introduction plate.

An exhaust gas feeding device in accordance with the present invention is particularly simple and economical to produce so that assembly only requires very slight effort and adjustment.

Preferably, the exhaust gas introduction plate is also a seal.

Because the exhaust gas introduction plate, in accordance with the present invention, comprises further openings that connect with various passage sections (i.e., the exhaust gas feedback passage section, the cooling medium passage section, and the exhaust gas passage section) of the intake manifold and the exhaust gas feedback valve, it is possible to form the exhaust gas passage by using a single component (i.e., the exhaust gas introduction plate) attached to the intake manifold whereby the exhaust gas introduction plate seals, and separates from one another, the respective individual passage sections of the exhaust gas feeding device.

SUMMARY OF THE INVENTION

In accordance with the above objectives, the present invention provides in a first illustrative apparatus embodiment an exhaust gas feeding device for an internal combustion machine, for introducing exhaust gas to a suction channel section of an intake manifold through at least one opening, wherein the exhaust gas feeding device includes:

(a) an exhaust gas feeding section provided with a first channel formed therein; (b) an exhaust gas feedback valve connected to the exhaust gas feeding section so exhaust gas is lead from the first channel to the exhaust gas feedback valve; and (c) an exhaust gas introduction plate connected to the exhaust gas feeding section, wherein the exhaust gas introduction plate includes a first opening that forms an annular channel with a suction channel section formed in a wall section of an intake manifold of an internal combustion machine when the exhaust gas feeding device is connected to the internal combustion machine; (d) wherein the exhaust gas introduction plate comprises a stamped piece having formable webs so that when the webs are formed to protrude away from the exhaust gas introduction plate the formed webs define a ring channel having ring openings therein when the exhaust gas plate is assembled with the wall section of the intake manifold.

In accordance with a second apparatus embodiment of the present invention, the first apparatus embodiment is further modified so that the exhaust gas introduction plate is a seal that seals an interface between the exhaust gas feeding device and the intake manifold. In accordance with third and fourth apparatus embodiments of the present invention, the first and second apparatus embodiments are respectively modified so that the exhaust gas introduction plate further comprises a plurality of second openings corresponding with exhaust conducting sections of the intake manifold and with the first channel leading to the exhaust gas feedback valve.

In accordance with a fifth apparatus embodiment of the present invention, an internal combustion machine is provided that includes: (a) an intake manifold having a wall section with a suction channel formed therein; (b) an exhaust gas feeding device assembled with the intake manifold so as to introduce exhaust gas to the suction channel of the intake manifold, wherein the exhaust gas feeding device comprises: (i) an exhaust gas feeding section provided with a first channel formed therein; (ii) an exhaust gas feedback valve connected to the exhaust gas feeding section thus leading exhaust gas from the first channel to the exhaust gas feedback valve; and (iii) an exhaust gas introduction plate connected to the exhaust gas feeding section, wherein the exhaust gas introduction plate includes a first opening formed therein that forms an annular channel with the suction channel section formed in the wall section of the intake manifold; (d) wherein the exhaust gas introduction plate is a stamped piece having formable webs that are formed to protrude away from the exhaust gas introduction plate so as to define a ring channel with ring openings therein when the exhaust gas introduction plate is assembled with the wall section of the intake manifold.

In accordance with a sixth apparatus embodiment of the present invention, the fifth apparatus embodiment is modified so that the exhaust gas introduction plate provides a seal that seals an interface between the exhaust gas feeding device and the intake manifold. In accordance with a seventh apparatus embodiment of the present invention, the sixth apparatus embodiment is further modified to include a cooling device connected to the intake manifold, wherein the cooling device contains a cooling medium in a first cooling medium channel, and wherein the intake manifold includes a second cooling medium channel formed in the wall section of the intake manifold, and the exhaust gas introduction plate further comprises a third opening formed therein and corresponding to the second cooling medium channel so the exhaust gas introduction plate provides a seal sealing an interface between the intake manifold and a cover assembly so cooling medium is sealed in the first cooling medium channel and the second cooling medium channel. In accordance with an eighth apparatus embodiment of the present invention, the seventh apparatus embodiment is modified so the exhaust gas introduction plate further comprises a fourth opening formed therein, wherein the fourth opening corresponds to the first channel of the exhaust gas feeding section so that the fourth opening and the first channel form a fourth contiguous channel through which exhaust gas flows from the internal combustion machine to the exhaust gas feedback valve. In accordance with a ninth apparatus embodiment of the present invention, the eighth apparatus embodiment is modified so the exhaust gas introduction plate further comprises one or more fifth openings formed therein, wherein each fifth opening corresponds to an exhaust gas channel formed in the wall section of the intake manifold so that each fifth opening and corresponding exhaust gas channel forms a seal at the interface between the intake manifold and the cover assembly when the cover assembly is attached to the intake manifold.

In accordance with a first method embodiment of the present invention, a method of assembling an exhaust gas feeding device to an internal combustion machine is provided that includes the steps of: (a) providing an exhaust gas feeding device comprising: (i) an exhaust gas feeding section provided with a first channel formed therein; (ii) an exhaust gas feedback valve connected to the exhaust gas feeding section for leading exhaust gas from the first channel to the exhaust gas feedback valve; and (iii) an exhaust gas introduction plate connectable to the exhaust gas feeding section, wherein the exhaust gas introduction plate includes a first opening formed therein; wherein the exhaust gas introduction plate is a stamped piece having formable webs that are modifiable to protrude away from the exhaust gas introduction plate; (b) providing an internal combustion machine comprising an intake manifold having a wall section with a suction channel formed therein; (c) forming the formable webs to protrude away from the exhaust gas introduction plate and to define a ring channel with ring openings therein; and (d) assembling the exhaust gas feeding device to the intake manifold of the internal combustion machine to dispose the exhaust gas introduction plate at an interface between the wall section of the intake manifold and the exhaust gas feeding section and so that the ring channel with ring openings therein forms an annular channel with the suction channel section formed in the wall section of the intake manifold.

In accordance with a second method embodiment of the present invention, the first method embodiment is modified so that when the exhaust gas feeding device is assembled to the internal combustion machine, the exhaust gas introduction plate forms a seal sealing the interface between the exhaust gas feeding device and the intake manifold so that exhaust gas flowing from the exhaust gas feeding device to the suction channel of the intake manifold does not leak from the interface.

The invention will be more fully described as follows with reference to the figures and illustrative embodiments. Further objects, features and advantages of the present invention will become apparent from the Detailed Description of Illustrative Embodiments, which follows, when considered together with the attached drawings.

DETAILED DESCRIPTION OF THE ILLUSTRATIVE EMBODIMENTS

Figure 1:
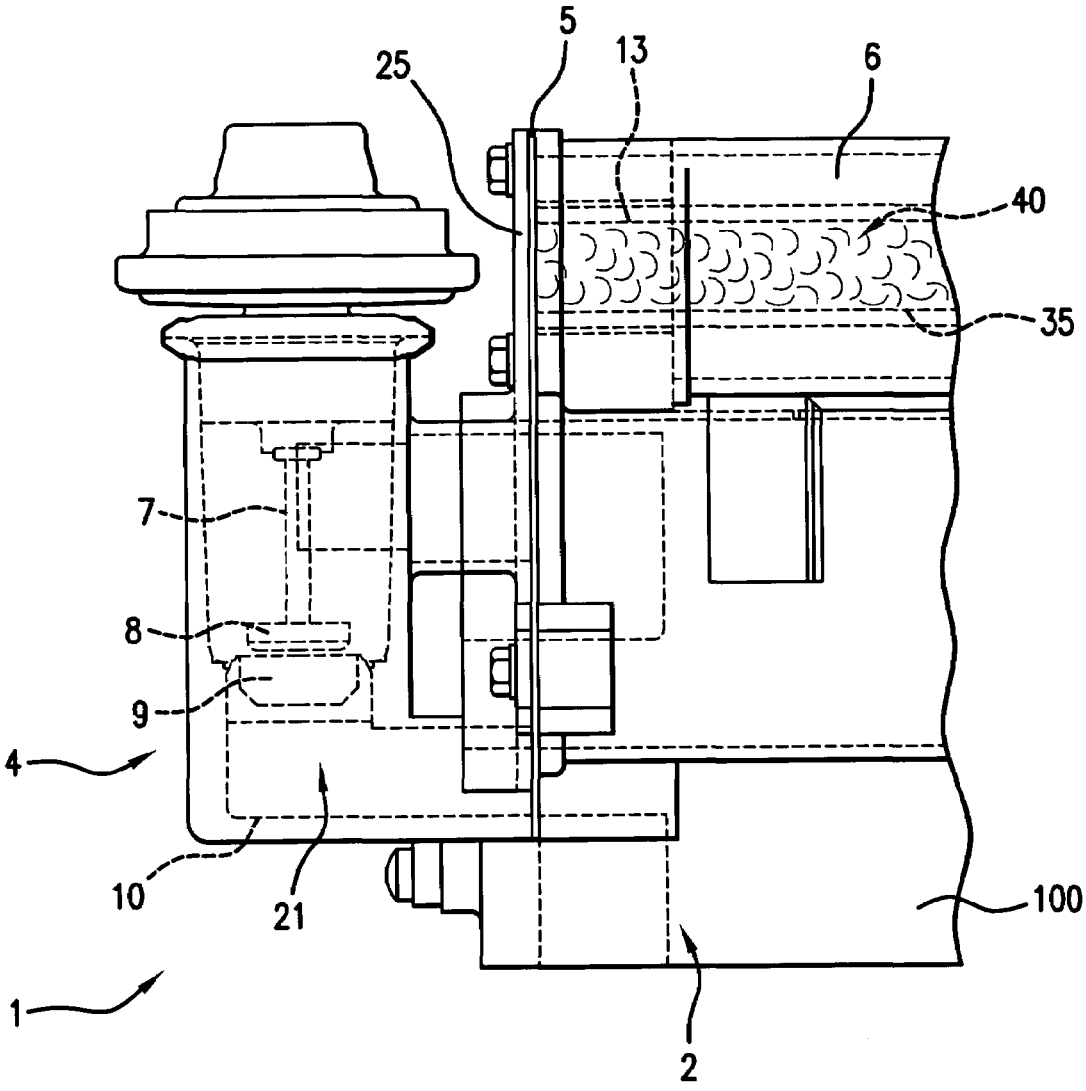
FIG. 1 is a schematic side view of an exhaust gas feeding device in accordance with the present invention.

The present invention is described with reference to the drawings, where like parts have been identified using like reference characters. The present invention includes an exhaust gas feeding device for an internal combustion machine, for introducing exhaust gas to a suction channel section of an intake manifold through at least one opening; an internal combustion machine, and a method of assembling an exhaust gas feeding device to an internal combustion machine. First, the illustrative apparatus embodiments in accordance with the present invention will be described followed by a description of the illustrative method embodiments.

Figure 2:
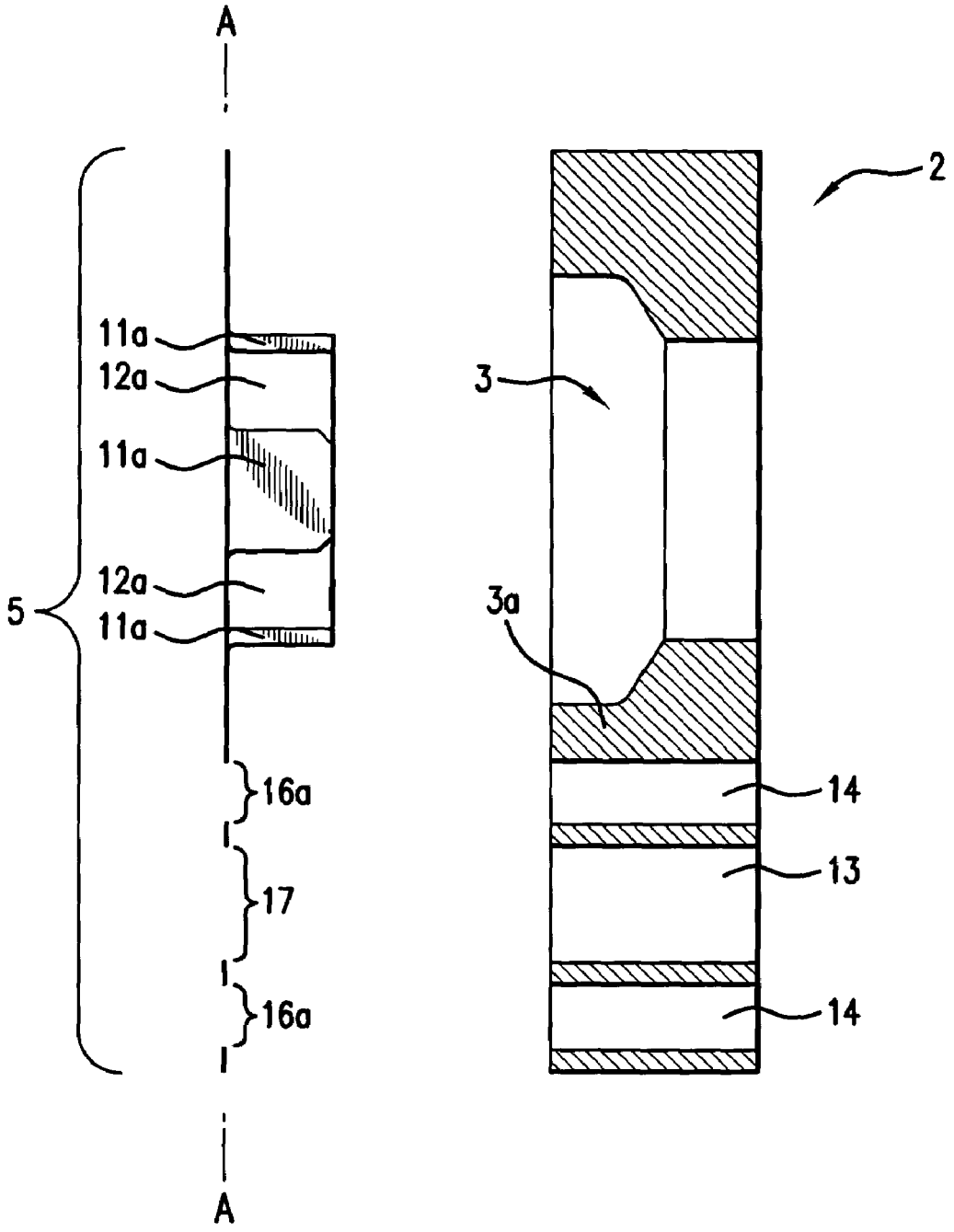
FIG. 2 is a schematic exploded side view in cross-section of a portion of the intake manifold with the exhaust gas introduction plate still separated therefrom shortly before assembly.
Figure 3:
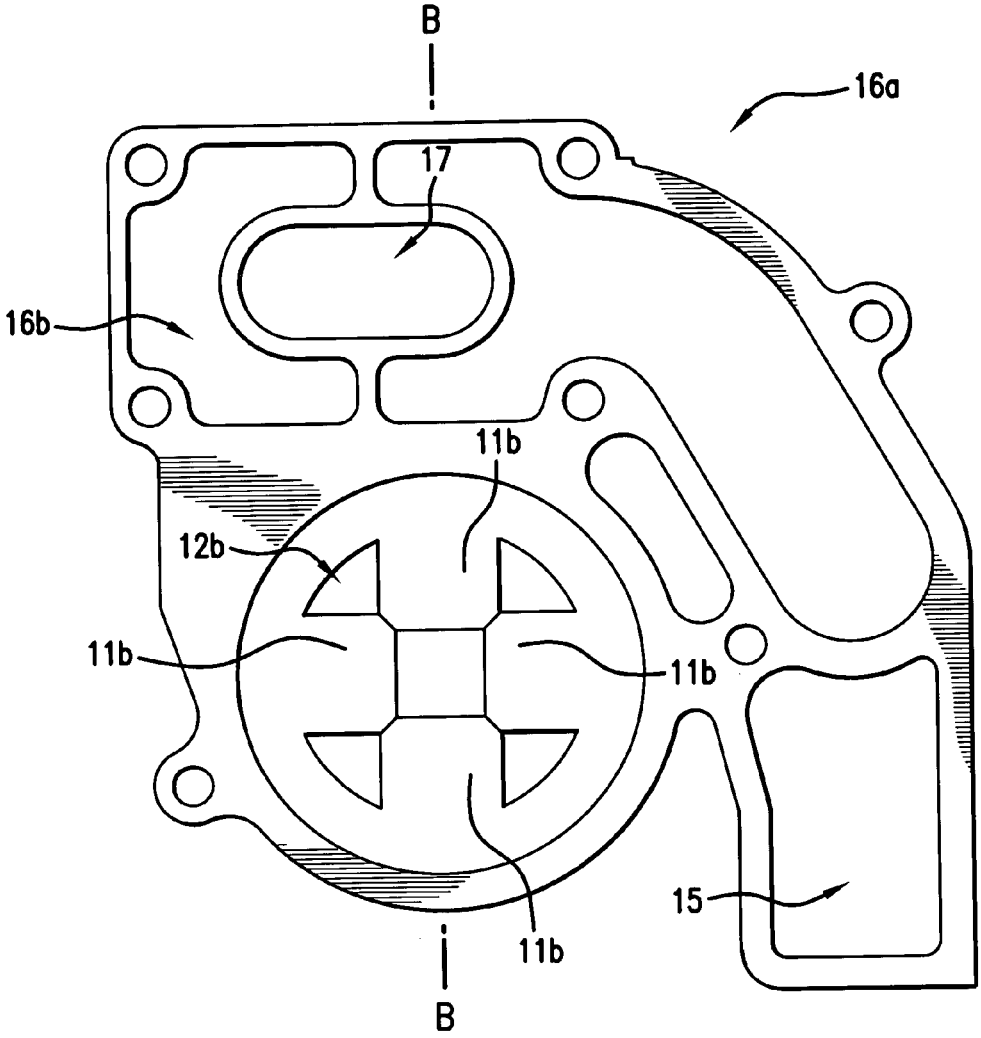
FIG. 3 is a schematic plan view of the exhaust gas introduction plate, in accordance with the present invention, but after the stamping process and before forming and assembly with the intake manifold.
Figure 4:
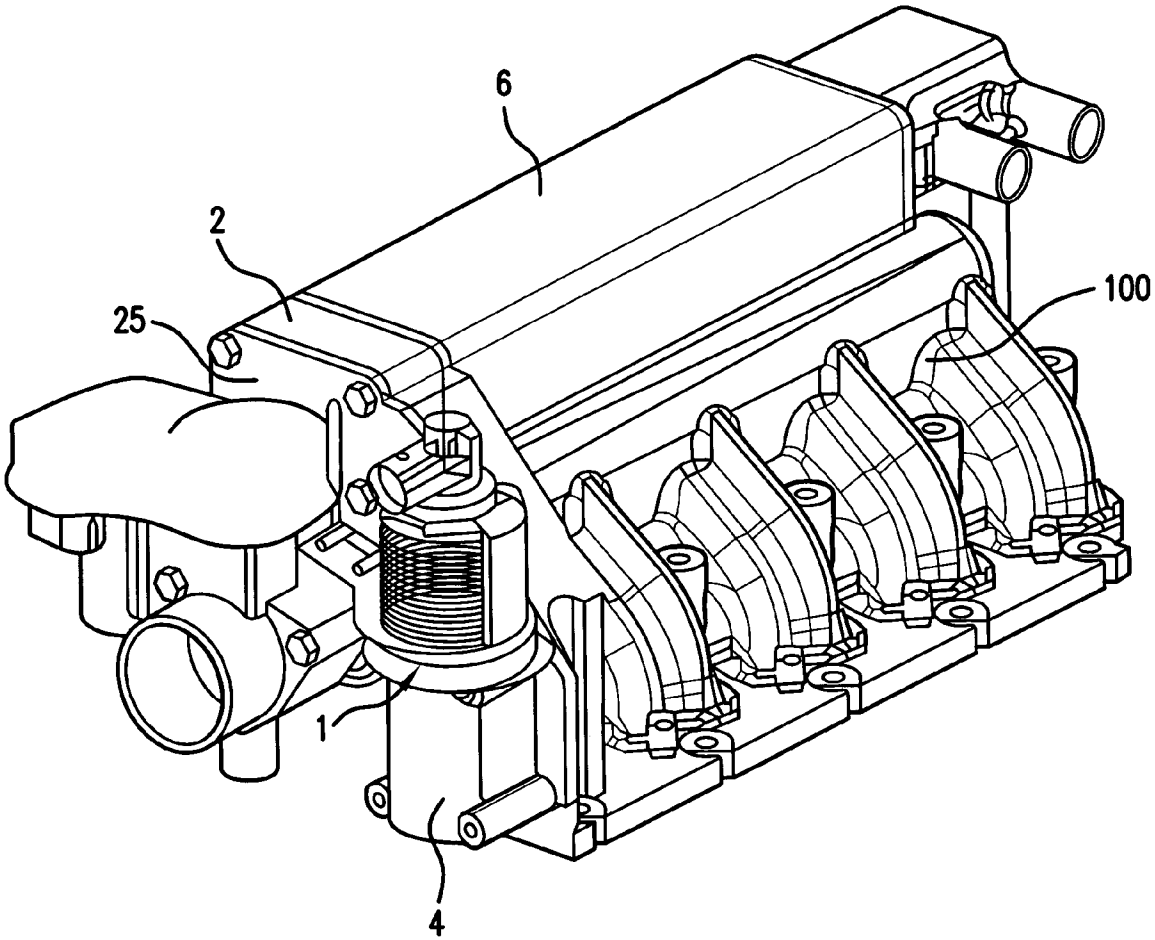
FIG. 4 is a perspective view of an internal combustion machine that includes an exhaust gas feeding device, in accordance with the present invention, assembled to the manifold intake of the machine.

FIGS. 1 and 4 illustrate an exhaust gas feeding device 1, in accordance with the present invention, that is arranged on an intake manifold 2 of an internal combustion machine or engine 100 for introducing exhaust gas into a vacuum or suction channel section 3 of the intake manifold (see FIG. 2). The exhaust gas feeding device 1 includes, in the present embodiment of the invention, (a) an exhaust gas feedback valve 4 and (b) an exhaust gas introduction plate 5, both being schematically represented in the Figures. The exhaust gas introduction plate 5 simultaneously forms a seal by which the exhaust gas feedback valve 4 is sealed and flanged onto the intake manifold 2. A cover assembly 25 is used to secure the exhaust gas introduction plate 5 to the intake manifold 2. Furthermore, a cooling device 6 of the internal combustion engine, as shown in FIGS. 1 and 4, is connected with the exhaust gas feeding device 1 via the intake manifold 2 so that exhaust gas can be cooled by the cooling device or cooler 6 and then fed back to the exhaust gas feedback valve 4. The precise structure of the exhaust gas introduction plate 5, and how it intercommunicatably functions together with the intake manifold 2, the exhaust gas feedback valve 4, and the cooling device 6, will be described later with reference to FIGS. 2, 3 and 5.

The schematic representation of the exhaust gas feedback valve, as shown in FIG. 1, makes clear that the exhaust gas feedback valve 4 is constructed with an upwardly-actuating valve stem 7 with a valve plate 8 that can open, or seal, an exhaust gas feeding section 10 of valve 4 over a valve seat 9.

FIG. 2 shows a side sectional view of an exhaust gas introduction plate 5, constructed in accordance with the present invention, shortly before it is assembled onto an intake manifold 2, which includes a suction channel section 3 formed in a wall section or region 3*a* of the intake manifold. FIG. 2 shows a sectional view of the exhaust gas introduction plate 5 taken along the line B—B of unmodified stamped piece shown in FIG. 3.

When the modified exhaust gas introduction plate 5 is assembled together with the intake manifold 2, the formed webs 11*a* of plate 5 fit into the suction channel section 3 of the intake manifold 2. A person skilled in the art would recognize that the unformed or formable webs I 1*b* of the newly stamped exhaust gas introduction plate 5 illustrated in FIG. 3 correspond to the formed webs 11*a* of the exhaust gas introduction plate 5 illustrated in FIG. 2. The difference between FIGS. 2 and 3 is that in FIG. 2 the formed webs 11*a* have been modified to protrude away from the plate 5, whereas in FIG. 3 the unformed webs 11*b* are oriented in the plane defined by plate 5. In particular, line A—A shown in FIG. 2 marks a cross section of the plane defined by plate 5. The unformed webs 11*b* of FIG. 3 are modified to form the formed webs 11*a* shown in FIG. 2 by bending or pushing, or by manipulation through some other means, the unformed webs 11*b* into position so as to form the formed webs 11*a*.

Figure 5:
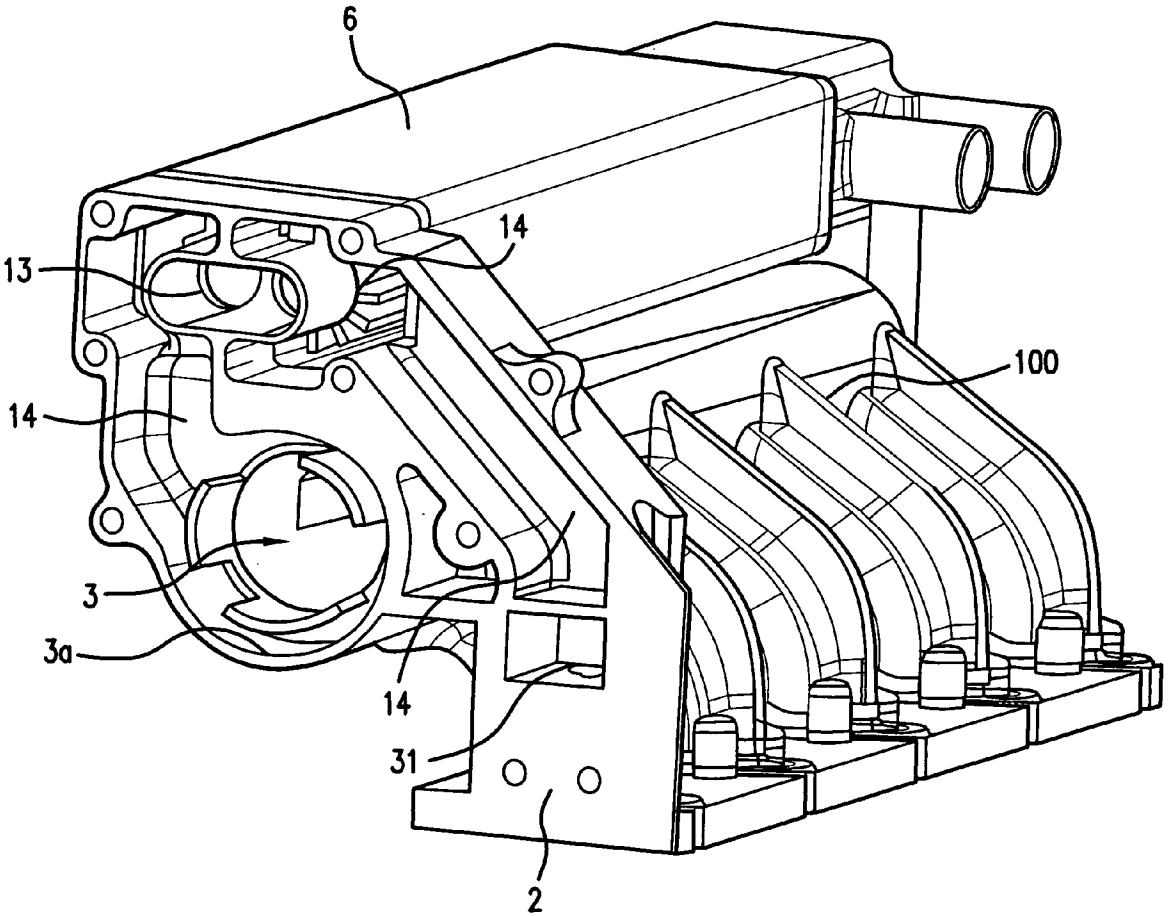
FIG. 5 is a perspective view of the internal combustion machine shown in FIG. 4 with the cover assembly and the exhaust gas introduction plate removed so as to show the structure of the intake manifold.

FIGS. 2 and 5 show, in a schematic manner, a section of the intake manifold 2, which has a cooling medium channel 13 and exhaust gas channels 14. When the exhaust gas feeding device 1, in accordance with the present invention, is properly assembled with the intake manifold 2, the device 1 will also be connected to the cooling device 6 so that exhaust gas fed into the exhaust gas channels 14 of the intake manifold 2 will be cooled in a known manner by use of a cooling medium 40 in the cooling medium channel 35 of the cooling device 6. The cooling medium 40 flowing in the cooling medium channel 13 of the intake manifold 2 flows in from cooling device 6, which contains the cooling medium 40.

FIG. 3 shows a plan view of the exhaust gas introduction plate 5, in accordance with one embodiment of the present invention, wherein plate 5 is a stamped piece or sheet. The exhaust gas introduction plate 5 shown in FIG. 3, having unformed webs 11*b*, is referred to as the unmodified or stamped plate, whereas the exhaust gas introduction plate shown in FIG. 3 having formed webs 11*a* is referred to as the modified plate. In the case of the unmodified plate 5, the webs 11*a* are not yet formed, but are the unformed webs 11*b* oriented in the plane defined by the stamped sheet After forming the modified webs 11*a* by moving the unformed webs 11*b* so as to protrude away from the plate 5, the modified exhaust gas introduction plate may be assembled onto intake manifold 2 so that the webs 11*a*, together with the wall region 3*a* of the suction channel section 3 of the intake manifold 2, form a ring channel, or annular channel, in which exhaust gas is fed to the suction channel section 3 in a known manner. Ring openings 12*a* provided between the webs 11*a*, which can be seen from FIG. 2 and result when forming the webs 11*a*, facilitate modified web 11*a* formation.

Furthermore, the exhaust gas introduction plate 5, as evident from FIG. 3, has several openings 15, 16*a*, 16*b* and 17 in it, in addition to the openings 12*b* that will correspondingly match to the suction channel section 3 of the intake manifold 2. The openings 15, 16*a*, 16*b* and 17 correspond respectively to various channels formed in the intake manifold 2 and in the exhaust gas feeding device 1. Specifically, opening 15 of plate 5 is configured to correspond to channel 21 of the exhaust gas feeding device 1 and to exhaust gas channel 31 of the intake manifold 2. Opening 16*a* of plate 5 is configured to correspond to one of the exhaust gas channels 14 formed in the intake manifold 2, and opening 16*b* is configured to correspond to a different and separate one of the exhaust gas channels 14 formed in the intake manifold 2. Opening 17 of plate 5 is configured to correspond to the cooling medium channel 13 of the intake manifold 2.

In this manner, when the exhaust gas feeding device 1 is assembled with the intake manifold 2 and cooling device 6 of the internal combustion machine, and secured in place by cover assembly 25, such as shown in FIGS. 1 and 4, the introduction plate 5 is properly assembled, and aligned with, the intake manifold 2 so that the opening 15 is contiguous with the channels 21 and 31, thereby providing a contiguous sealed channel that leads exhaust gas across the interface between the intake manifold 2 and the exhaust gas feedback device 1 to the exhaust gas feedback valve 4. Likewise, when the introduction plate 5 and the intake manifold 2 are properly connected together using the cover assembly 25, the openings 16*a* and 16*b* respectively correspond to, and seal, different exhaust gas channels 14. Similarly, when assembled together, opening 17 of plate 5 corresponds to, and is contiguous with, cooling medium channel 13 of intake manifold 2 so as to seal this channel at the interface.

With this structure, when the exhaust gas feeding device 1 is assembled with the intake manifold 2, the cooling device 6 and the cover assembly 25, the exhaust gas introduction plate 5 is disposed at the interface between the intake manifold 2 and the exhaust gas feeding device 6 attached to the cover assembly 25, and provides a seal between the exhaust gas feeding device 1 and the intake manifold 2. Consequently, exhaust gas does not leak, or escape from, the interface between these structures. In addition, an end of the cooling medium channel 13 is sealed so that cooling medium 40 does not leak out of the cooling channel and into the exhaust gas channels 14.

In other words, the exhaust gas introduction plate 5, in accordance with the present invention, provides an inexpensive seal to make, and then assemble at the interface between the exhaust gas feeding device 1 and the intake manifold 2 and cooling device 6 of the internal combustion machine so that exhaust gas does not leak from the section suction channel and the exhaust gas channels, or into the cooling medium channel 17. A person skilled in the art would realize from the configuration of the various channels in the intake manifold 2, that in order to ensure the exhaust gas introduction plate 5 makes a proper seal at the interface between the manifold 2 and the cover assembly 25 attached to the exhaust gas feeding device 1, proper positioning of the plate 5 is important. The ring channel with ring openings formed therein by the formed webs 11*a* and the openings 12*a* of the plate 5 serve this purpose when fitted into the suction channel 3 of the intake manifold 2.

Having fully described several illustrative apparatus embodiments in accordance with the present invention, the illustrative method embodiments will be described. In accordance with the present invention, an exhaust gas feeding device is assembled with, or connected to, an internal combustion machine, by performing the following steps. First, an exhaust gas feeding device is provided, such as shown in FIG. 1, that comprises: (a) an exhaust gas feeding section provided with a first channel formed therein; (b) an exhaust gas feedback valve connected to the exhaust gas feeding section for leading exhaust gas from the first channel to the exhaust gas feedback valve; and (c) an exhaust gas introduction plate connectable to the exhaust gas feeding section, wherein the exhaust gas introduction plate includes a first opening formed therein, wherein the exhaust gas introduction plate is a stamped piece having formable webs that are formable to protrude away from the exhaust gas introduction plate. At this stage of the method of assembly, the exhaust gas introduction plate 5 is the unmodified stamped plate shown in FIG. 3.

In a second step, an internal combustion machine is provided that comprises an intake manifold having a wall section with a suction channel formed therein. In a third step, the formable webs 11*b* are formed so as to protrude away from the exhaust gas introduction plate and so as to define a ring channel with ring openings therein. In the third step, the formable webs 11*a* are formed by bending, pushing, or the like, and as the formable webs are formed to form the formed webs 11*a*, the ring openings 12*a* are simultaneously formed.

In the fourth step, the exhaust gas feeding device is assembled to the intake manifold of the internal combustion machine so that the exhaust gas introduction plate is disposed at an interface between the wall section of the intake manifold and the exhaust gas feeding section and so that the ring channel with ring openings therein forms an annular channel with the suction channel section formed in the wall section of the intake manifold. When the exhaust gas feeding device is assembled to the internal combustion machine, preferably the exhaust gas introduction plate forms a seal that seals the interface between the exhaust gas feeding device and the intake manifold so that exhaust gas flowing from the exhaust gas feeding device to the suction channel of the intake manifold, when the internal combustion machine is operating, does not leak from the interface.

While the present invention has been described with reference to certain illustrative embodiments, one of ordinary skill in the art will recognize that additions, deletions, substitutions, modifications and improvements can be made while remaining within the spirit and scope of the present invention as defined by the appended claims.

What is claimed is:

1. An exhaust gas feeding device for an internal combustion machine, for introducing exhaust gas to a suction channel section of an intake manifold through at least one opening, the exhaust gas feeding device comprising:

an exhaust gas feeding section provided with a first channel formed therein;

an exhaust gas feedback valve connected to the exhaust gas feeding section so exhaust gas is lead from the first channel to the exhaust gas feedback valve; and an exhaust gas introduction plate connected to the exhaust gas feeding section, wherein the exhaust gas introduction plate includes a first opening that forms an annular channel with a suction channel section formed in a wall section of an intake manifold of an internal combustion machine when the exhaust gas feeding device is connected to the internal combustion machine;

wherein the exhaust gas introduction plate comprises a stamped piece having formable webs so that when the webs are formed to protrude away from the exhaust gas introduction plate the formed webs define a ring channel having ring openings therein when the exhaust gas plate is assembled with the wall section of the intake manifold.

2. An exhaust gas feeding device according to claim 1, wherein the exhaust gas introduction plate further comprises a plurality of second openings corresponding with exhaust conducting sections of the intake manifold and with the first channel leading to the exhaust gas feedback valve.

3. An exhaust gas feeding device according to claim 1, wherein the exhaust gas introduction plate is a seal that seals an interface between the exhaust gas feeding device and the intake manifold.

4. An exhaust gas feeding device according to claim 3, wherein the exhaust gas introduction plate further comprises a plurality of second openings corresponding with exhaust conducting sections of the intake manifold and with the first channel leading to the exhaust gas feedback valve.

5. An internal combustion machine comprising:

(a) an intake manifold having a wall section with a suction channel formed therein;

(b) an exhaust gas feeding device assembled with the intake manifold so as to introduce exhaust gas to the suction channel of the intake manifold, wherein the exhaust gas feeding device comprises:

i. an exhaust gas feeding section provided with a first channel formed therein;

ii. an exhaust gas feedback valve connected to the exhaust gas feeding section thus leading exhaust gas from the first channel to the exhaust gas feedback valve; and iii. an exhaust gas introduction plate connected to the exhaust gas feeding section, wherein the exhaust gas introduction plate includes a first opening formed therein that forms an annular channel with the suction channel section formed in the wall section of the intake manifold;

wherein the exhaust gas introduction plate is a stamped piece having formable webs that are formed to protrude away from the exhaust gas introduction plate so as to define a ring channel with ring openings therein when the exhaust gas introduction plate is assembled with the wall section of the intake manifold.

6. An internal combustion machine according to claim 5, wherein the exhaust gas introduction plate provides a seal that seals an interface between the exhaust gas feeding device and the intake manifold.

7. A method of assembling an exhaust gas feeding device to an internal combustion machine, the method comprising the steps of:

(a) providing an exhaust gas feeding device comprising:

i. an exhaust gas feeding section provided with a first channel formed therein;

ii. an exhaust gas feedback valve connected to the exhaust gas feeding section for leading exhaust gas from the first channel to the exhaust gas feedback valve; and iii. an exhaust gas introduction plate connectable to the exhaust gas feeding section, wherein the exhaust gas introduction plate includes a first opening formed therein;

wherein the exhaust gas introduction plate is a stamped piece having formable webs that are modifiable to protrude away from the exhaust gas introduction plate;

(b) providing an internal combustion machine comprising an intake manifold having a wall section with a suction channel formed therein;

(c) forming the formable webs to protrude away from the exhaust gas introduction plate and to define a ring channel with ring openings therein; and (d) assembling the exhaust gas feeding device to the intake manifold of the internal combustion machine to dispose the exhaust gas introduction plate at an interface between the wall section of the intake manifold and the exhaust gas feeding section and so that the ring channel with ring openings therein forms an annular channel with the suction channel section formed in the wall section of the intake manifold.

8. A method as recited in claim 7, wherein when the exhaust gas feeding device is assembled to the internal combustion machine, the exhaust gas introduction plate forms a seal sealing the interface between the exhaust gas feeding device and the intake manifold so that exhaust gas flowing from the exhaust gas feeding device to the suction channel of the intake manifold does not leak from the interface.

9. An internal combustion machine comprising:

(a) an intake manifold having a wall section with a suction channel formed therein;

(b) an exhaust gas feeding device assembled with the intake manifold so as to introduce exhaust gas to the suction channel of the intake manifold, wherein the exhaust gas feeding device comprises:

i. an exhaust gas feeding section provided with a first channel formed therein;

ii. an exhaust gas feedback valve connected to the exhaust gas feeding section thus leading exhaust gas from the first channel to the exhaust gas feedback valve; and iii. an exhaust gas introduction plate connected to the exhaust gas feeding section, wherein the exhaust gas introduction plate includes a first opening formed therein that forms an annular channel with the suction channel section formed in the wall section of the intake manifold;

wherein the exhaust gas introduction plate is a stamped piece having formable webs that are formed to protrude away from the exhaust gas introduction plate so as to define a ring channel with ring openings therein when the exhaust gas introduction plate is assembled with the wall section of the intake manifold and the exhaust gas introduction plate provides a seal that seals an interface between the exhaust gas feeding device and the intake manifold, and the internal combustion machine further comprises (c) a cooling device connected to the intake manifold, wherein the cooling device contains a cooling medium in a first cooling medium channel, and wherein the intake manifold includes a second cooling medium channel formed in the wall section of the intake manifold, and the exhaust gas introduction plate further comprises a third opening formed therein and corresponding to the second cooling medium channel so the exhaust gas introduction plate provides a seal sealing an interface between the intake manifold and a cover assembly so cooling medium is sealed in the first cooling medium channel and the second cooling medium channel.

10. An internal combustion machine according to claim 9, wherein the exhaust gas introduction plate further comprises a fourth opening formed therein, wherein the fourth opening corresponds to the first channel of the exhaust gas feeding section so that the fourth opening and the first channel form a fourth contiguous channel through which exhaust gas flows from the internal combustion machine to the exhaust gas feedback valve.

11. An internal combustion machine according to claim 10, wherein the exhaust gas introduction plate further comprises one or more fifth openings formed therein, wherein each fifth opening corresponds to an exhaust gas channel formed in the wall section of the intake manifold so that each fifth opening and corresponding exhaust gas channel forms a seal at the interface between the intake manifold and the cover assembly when the cover assembly is attached to the intake manifold.

* * * * *